US007086556B1

(12) United States Patent
Trulove-Cranor

(10) Patent No.: US 7,086,556 B1
(45) Date of Patent: Aug. 8, 2006

(54) TWO-PIECE JUICE BOX HOLDER

(76) Inventor: Whitney A. Trulove-Cranor, 10213 Zenobia Cir., Westminster, CO (US) 80031

( * ) Notice: Subject to any disclaimer, the term of this patent is extended or adjusted under 35 U.S.C. 154(b) by 75 days.

(21) Appl. No.: 10/841,587

(22) Filed: May 7, 2004

Related U.S. Application Data

(60) Provisional application No. 60/526,396, filed on Dec. 1, 2003.

(51) Int. Cl.
*B65D 25/22* (2006.01)

(52) U.S. Cl. ..... 220/740

(58) Field of Classification Search ..... None
See application file for complete search history.

(56) References Cited

U.S. PATENT DOCUMENTS 4,724,976 A * 2/1988 Lee ..... 220/8
5,180,088 A * 1/1993 de Angeli ..... 224/544
5,944,210 A * 8/1999 Yetter ..... 220/4.21

* cited by examiner

*Primary Examiner*—Stephan Castellano
(74) *Attorney, Agent, or Firm*—Edwin H. Crabtree; Ramon L. Pizarro

(57) ABSTRACT

An adjustable two-piece juice box holder used for holding juice boxes and the like and preventing spillage when the box is opened and a straw is inserted into an opening in the top of the box and the liquid contents therein is consumed. The holder includes a bottom housing having an open top, a closed bottom, a first side, a second side, a third side and a fourth side. A top portion of the first and third sides includes an outwardly extending push button. A pair of vertical, parallel slits are disposed on opposite sides of the push buttons. The slits provide for forming a pair of flexible tabs in the top portion of the first side and the opposite third side. The flexible tabs with push buttons are used for releasably securing the bottom housing to a top housing. The top housing includes an open bottom, a semi-open top with a frame therearound, a first side, a second side, a third side and a fourth side. The first side and the opposite third side include a lower button hole and an upper button hole. The button holes are used for receiving the push buttons on the tabs when the bottom housing is slidably received inside the open bottom of the top housing.

15 Claims, 2 Drawing Sheets

TWO-PIECE JUICE BOX HOLDER

This application is based on an earlier filed provisional application filed on Dec. 1, 2003, Ser. No. 60/526,396, by the subject inventor and having a title of "JUICE BOX HOLDER".

BACKGROUND OF THE INVENTION (a) Field of the Invention

This invention relates to a juice box holder and more particularly, but not by way of limitation, to an adjustable two-piece juice box holder for holding different sizes of flexible juice boxes and foil-like liquid pouches. The juice box holder is designed to prevent spillage when a box or pouch is opened and held by a user.

(b) Discussion of Prior Art

Heretofore, there have been a variety of different types of container holders, juice box holders and the like. For example, in U.S. Design Pat. 329,357 to Lebensfeld, a beverage container holder is illustrated. In U.S. Design Pat. 149,866 to Fry, a holder for a paper milk carton is shown. In U.S. Pat. No. 5,150,811 to Kelston, a squeeze resistant holder for a juice box is disclosed. The holder includes a hinged housing with an open top for inserting a straw into the top of the juice box. A stopper is included for covering a straw opening when the juice box is not in use. In U.S. Pat. No. 5,292,021 to Lyon, a holder for a liquid package is described. The holder is a hollow container with a hinged lid. The lid has sharp point for puncturing the top of the package and a mouthpiece for receiving a liquid from the punctured package. In U.S. Pat. No. 5,052,575 to Ravreby, a holder for an aseptic package is disclosed. The holder includes a container with a removable cover and stopper disposed under the cover for securing a straw hole. In U.S. Pat. No. 5,950,857 to Rosen, a liquid box holder is shown for holding a juice box. The holder includes a lid with drink spout, an air regulating valve and a fluid exit opening. In U.S. Pat. No. 4,986,435 to Wright, a receptacle for a box-style flexible beverage container is described. The receptacle includes sidewalls, a bottom and an open top for receiving the beverage container therein.

None of the above mentioned prior art patents specifically disclose the unique features, structure and function of the subject adjustable two-piece juice box holder for holding different size juice boxes and liquid filled foil-like pouches.

SUMMARY OF THE INVENTION

In view of the foregoing, it is a primary objective of the subject invention to provide a holder for juice boxes and the like and preventing spillage when the box is opened and a straw is inserted into an opening in the top of the box. The juice box holder is sufficiently rigid to prevent the squeezing of a flexible drink container and the spilling of liquid during the opening of the container and when drinking the liquid found therein.

Another object of the invention is the subject holder is made of lightweight plastic, it is rugged in construction and it is easily adapted for different sizes of juice boxes, foil-like liquid pouches, aseptic liquid packages and other similar containers used in holding liquid drinks.

Yet another object of the juice box holder is the juice box holder is designed to prevent young children from removing the juice box held therein. Also, the holder prevents the juice box from falling out of a semi-open top. The juice box holder also includes handles for ease in holding and carrying the holder.

The subject invention includes an angular shaped bottom housing having an open top, a closed bottom, a first side, a second side, a third side and a fourth side. A top portion of the first and third sides includes an outwardly extending push button. A pair of vertical, parallel slits are disposed on opposite sides of the push buttons. The slits provide for forming a pair of flexible tabs in the top portion of the first side and the opposite third side. The flexible tabs with push buttons are used for releasably securing the bottom housing to an angular shaped top housing.

The top housing includes an open bottom, a semi-open top with a frame therearound, a first side, a second side, a third side and a fourth side. The first side and the opposite third side include a lower button hole and an upper button hole. The button holes are used for receiving the push buttons on the tabs when the bottom housing is slidably received inside the open bottom of the top housing. Also, the first and third sides of the top housing include inverted "L" shaped handles extending outwardly and disposed next to the button holes.

These and other objects of the present invention will become apparent to those familiar with various types of juice box holders and other types of holders used in holding liquid containers when reviewing the following detailed description, showing novel construction, combination, and elements as herein described, and more particularly defined by the claims, it being understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
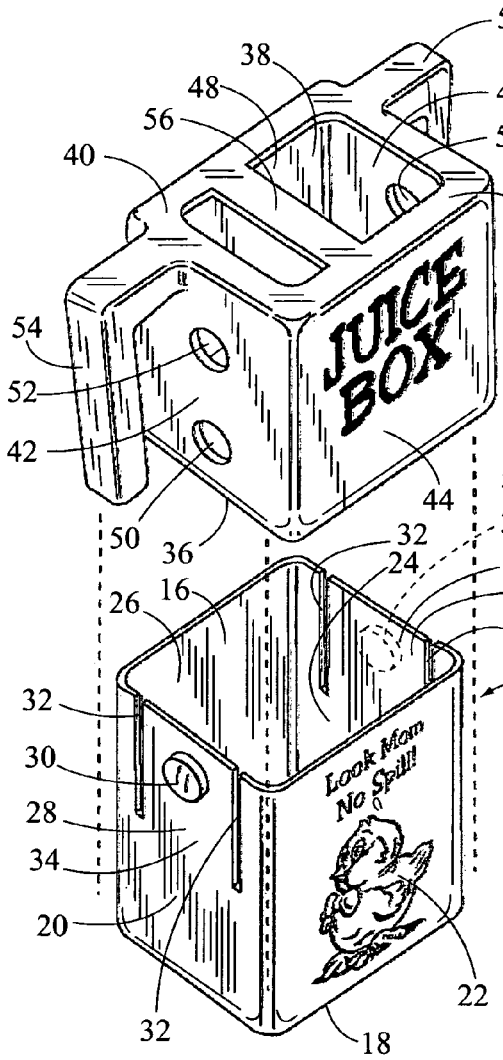
FIG. 1 is a perspective view of the subject adjustable two-piece juice box holder illustrating a bottom housing positioned for slidable receipt inside a top housing of the holder. A juice box is not shown in this drawing.

In FIG. 1, a perspective view of the subject adjustable two-piece juice box holder is shown as having a general reference numeral 10. The juice box holder 10 is made of durable and flexible hard plastic. Also the plastic material is rigid enough to prevent the squeezing of a juice box 11 or similar liquid container stored inside the holder 10. The juice box 11 is shown in dashed lines in FIGS. 3 and 4. The juice box holder 10 includes broadly an angular shaped bottom housing, having general reference numeral 12 and an angular shaped top housing, having a general reference numeral 14. In this drawing, the bottom housing 12 is positioned for slidable receipt inside the top housing 14.

The bottom housing 12 includes an open top 16, a closed bottom 18, a first side 20, a second side 22, a third side 24 and a fourth side 26. A top portion 28 of the first and third sides 20 and 24 includes an outwardly extending push button 30. A pair of vertical, parallel slits 32 are disposed on opposite sides of the push buttons 30. The slits 32 provide for forming a pair of flexible tabs 34 in the top portion 28 of the first side 20 and the opposite third side 24. The flexible tabs 34 with push buttons 30 are used for releasably securing the bottom housing 12 inside the top housing 14. While the flexible tabs 34 with push buttons 30 are shown in the drawings, it can be appreciated that other methods and devices of releasably securing the two housings 12 and 14 together will work equally well.

The top housing 14 includes an open bottom 36, a semi-open top 38 with a frame 40 therearound, a first side 42, a second side 44, a third side 46 and a fourth side 48. The first side 42 and the opposite third side 46 include a lower button hole 50 and an upper button hole 52. The button holes 50 and 52 are used for receiving the push buttons 30 on the tabs 34, when the bottom housing 12 is slidably received inside the open bottom 36 of the top housing 14. Also, the first and third sides 42 and 46 of the top housing 14 include inverted "L" shaped handles 54 extending outwardly and downwardly and disposed next to the button holes 50 and 52. The semi-open top 38 also includes an off-set rib 56. The rib 56 is used to prevent the juice box 11 from falling out of the holder 10 should it be turned upside down. Also, the rib 56 adds strength to the semi-open top 38 and prevents the top 38 from being pressed inwardly and squeezing the top of the juice box causing a liquid spill.

It should be noted that the second side 22 of the bottom housing 12 and the second side 44 of the top housing 14 provide a flat surface for adding various types of advertising, logos, brand names, animals and children's pictures to enhance the appeal and use of the juice box holder 10. Obviously, the other sides of the bottom and top housings 12 and 14 can also be used equally well for advertising.

Figure 2:
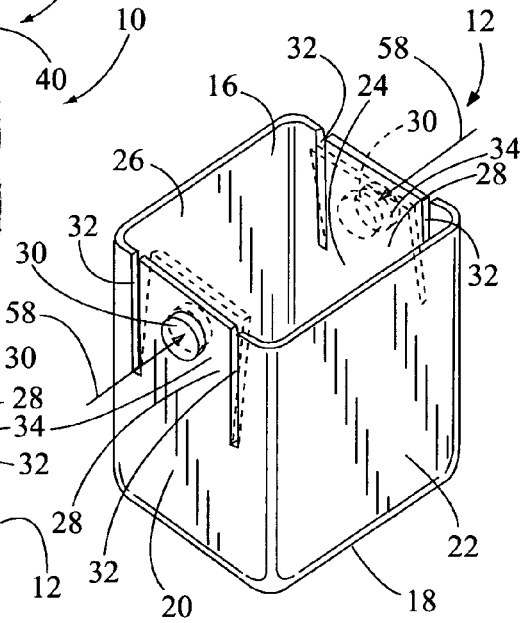
FIG. 2 is another perspective view of the bottom housing with flexible tabs in a first side and an opposite third side of the bottom housing. Push buttons on the tabs are used for receipt in button holes in a first and a third side of the top housing and securing the bottom housing inside the top housing.

In FIG. 2, another perspective view of the bottom housing 12 is shown with the flexible tabs 34 and push buttons 30 in the first side 20 and the opposite third side 24 and in an unflexed position in solid lines. Also, the buttons 30 and tabs 34, shown in dashed lines, are pushed inwardly, as indicated by arrows 58.

Figure 3:
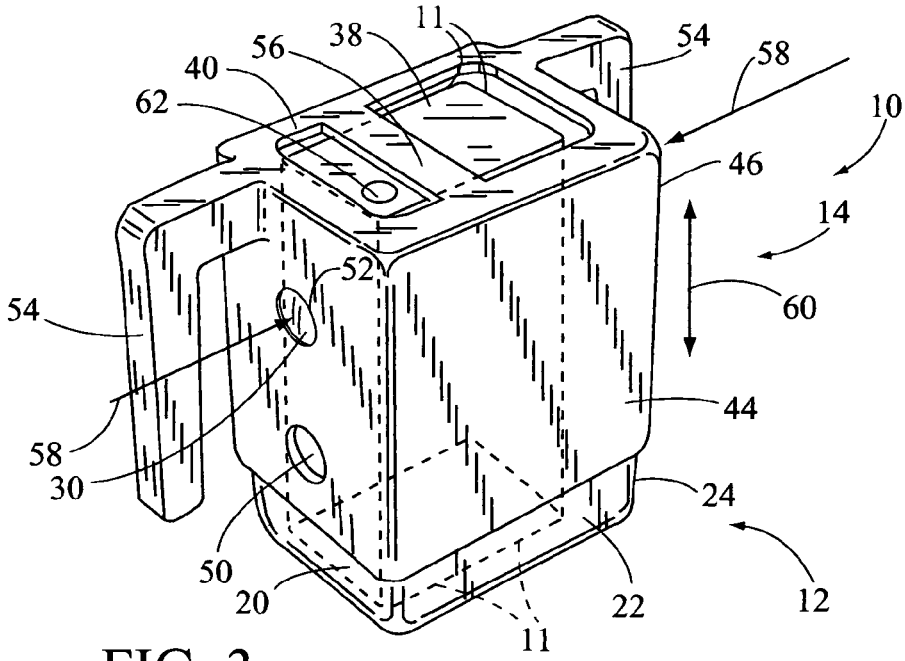
FIG. 3 is a perspective view of the juice box holder with the top housing releasably attached to the bottom housing with a small juice box held securely therein.
Figure 4:
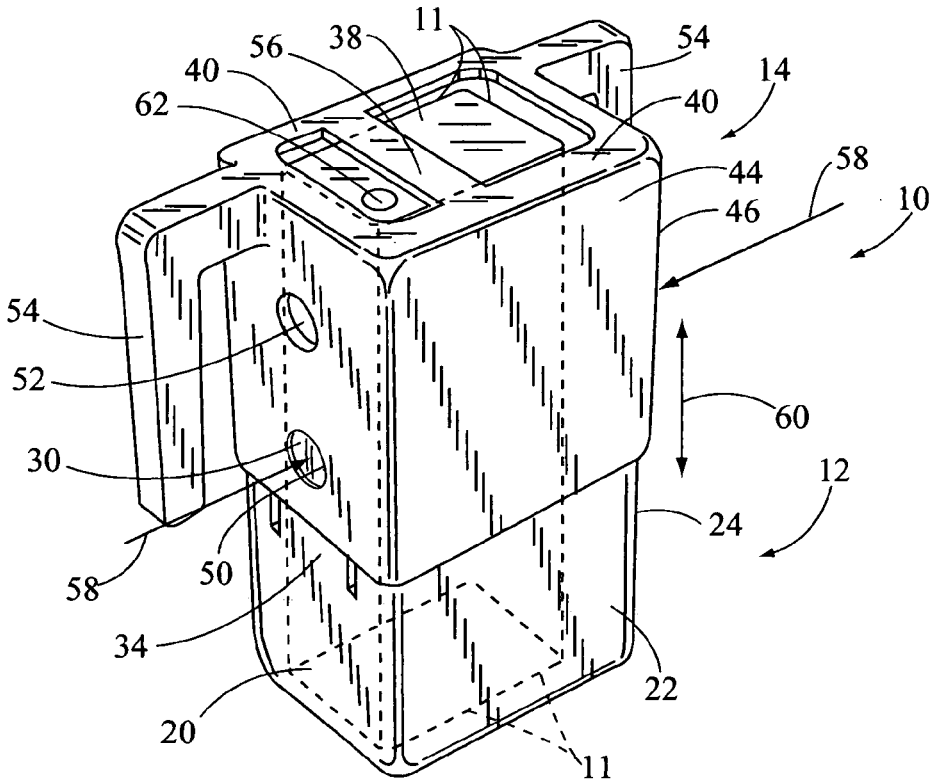
FIG. 4 is a perspective view of the juice box holder with the top housing raised on the bottom housing and releasably attached for holding a taller juice box therein.

In operation, the buttons 30 are compressed inwardly by the user's thumb and index finger, when slidably inserting the bottom housing 12 inside the open bottom 36 of the top housing 14, as shown in FIGS. 3 and 4. As the bottom housing 12 is telescoped upwardly inside the top housing 14, the flexible tabs 34 will automatically push outwardly and allow the push buttons 30, when indexed with the lower push button holes 50, to pop into the holes 50 as shown in FIG. 4. If the juice box 11 is a small container, the push buttons 30 can be released from the lower button holes 50, using the thumb and index finger. The bottom housing 12 is then further moved upwardly inside the top housing 14 until the push buttons 30 pop into the upper button holes 52, as shown in FIG. 3.

In FIG. 3, a perspective view of the juice box holder 10 is shown with the top housing 14 releasably attached around the bottom housing 12 with a small juice box 11 held securely therein. As mentioned above, the push buttons 30 are received in the upper button holes 52 of the top housing 14. The small juice box holder in this drawing typically has a height in range of 2½ to 3½ inches and a width and length in a range of 1½ to 2½ inches. An arrow 60 is shown for indicating how the bottom housing 12 can be raised and lowered inside the top housing 14 for adjusting the holder 10 to different size juice boxes and other juice containers.

In FIG. 4, a perspective view of the juice box holder 10 is shown with the top housing 14 raised on the bottom housing 12 and releasably secured for holding a large juice box 11 therein. In this example, the push buttons 30 are received in the lower button holes 50 of the top housing 14. The large juice box 11 shown in this drawing typically has a height in a range of 3½ to 4½ inches and a width and length in a range of 1½ to 2½ inches. While, the lower and upper button holes 50 and 52 are shown in the drawings, it can be appreciated that the holder 10 can have any number of button holes for adjusting to various sizes of juice boxes and the like.

In FIGS. 3 and 4, the two juice boxes 11 are shown with a straw opening 62 used for receiving a straw therethrough. The straw is not shown in the drawings. The semi-open top 38 with the off-set rib 56 is designed to provide ready access to different locations of straw openings in the top of various types and sizes of juice and drink containers using the subject two-piece adjustable juice box holder 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. An adjustable juice box holder, the juice box holder used for holding a juice box and similar juice and liquid containers, the holder comprising:

a bottom housing having an open top, a closed bottom, a first side, a second side, a third side and a fourth side, a top portion of the first and third sides includes an outwardly extending push button and a pair of vertical, parallel slits disposed on opposite sides of said push buttons, said slits provide for forming a pair of flexible tabs in the top portion of the first side and the opposite third side;

a top housing, said bottom housing slidably received inside said top housing, said top housing having an open bottom, a semi-open top, a first side, a second side, a third side and a fourth side, the first side and the opposite third side include a button hole, whereby said button holes are used for receiving said push buttons on said tabs when said bottom housing is received inside said top housing; and a pair of lifting handles attached to the first and third sides of said top housing, said handles offset from the vertical alignment of said button holes for ease in engaging and releasing said push buttons in said button holes and removing said top housing from said bottom housing.

2. The holder as described in claim 1 further including a lower button hole and an upper button hole in the first and third sides of said top housing.

3. The holder as described in claim 1 wherein said pair of handles having an inverted "L" shaped configuration for ease in gripping by a small child.

4. The holder as described in claim 1 wherein the semi-open top in said top housing has a frame therearound, said frame adapted for preventing the juice box from falling out of the holder should it be turned upside down.

5. The holder as described in claim 1 further including a rib having opposite ends attached to the second and fourth sides of the semi-open top of said top housing, said rib adapted for preventing a juice box from falling out of the open top when the holder is turned upside down and providing additional strength to said top housing and preventing the second and fourth sides from being pressed inwardly and squeezing the top of the juice box causing a liquid spill.

6. The holder as described in claim 1 wherein the second side of said bottom housing and the second side of said top housing have a flat surface for adding advertising, logos, brand names, animals and children's pictures to enhance the appeal and use of the juice box holder.

7. An adjustable juice box holder, the juice box holder used for holding a small and large juice box and similar juice and liquid containers, the holder comprising:

a bottom housing having an open top, a closed bottom, a first side, a second side, a third side and a fourth side, a top portion of the first and third sides includes an outwardly extending push button and a pair of vertical, parallel slits disposed on opposite sides of said push buttons, said slits provide for forming a pair of flexible tabs in the top portion of the first side and the opposite third side;

a top housing, said bottom housing slidably received inside said top housing, said top housing having an open bottom, a semi-open top, a first side, a second side, a third side and a fourth side, the first side and the opposite third side include an upper button hole and a lower button hole, whereby said button holes are used for receiving said push buttons on said tabs when said bottom housing is received inside said top housing, said upper button hole and said lower button hole used to adjust said top housing on said bottom housing for the small juice box or the large juice box; and a pair of lifting handles attached to the first and third sides of said top housing, said handles offset from the vertical alignment of said button holes for ease in engaging and releasing said push buttons in said button holes and removing said top housing from said bottom housing.

8. The holder as described in claim 7 wherein said pair of handles having an inverted "L" shaped configuration and attached to a top portion of the first and second sides of said top housing, said inverted "L" shaped configuration handles adapted for ease in gripping by a small child when using the juice box holder.

9. The holder as described in claim 7 wherein the semi-pen top in said top housing has an inwardly extending frame therearound, said frame adapted for preventing the juice box from falling out of the holder should it be turned upside down.

10. The holder as described in claim 9 further including an offset rib having opposite ends attached to a portion of said frame next to the second and fourth sides of the semi-open top of said top housing, said offset rib adapted for preventing a juice box from falling out of the open top when the holder is turned upside down and providing additional strength to said top housing and preventing the second and fourth sides from being pressed inwardly and squeezing the top of the juice box causing a liquid spill.

11. The holder as described in claim 7 wherein the second and fourth sides of said bottom housing and the second and fourth sides of said top housing have a flat surface for adding advertising, logos, brand names, animals and children's pictures to enhance the appeal and use of the juice box holder.

12. An adjustable juice box holder, the juice box holder used for holding a small and large juice box and similar juice and liquid containers, the holder comprising:

a bottom housing having an open top, a closed bottom, a first side, a second side, a third side and a fourth side, a top portion of the first and third sides includes an outwardly extending push button and a pair of vertical, parallel slits disposed on opposite sides of said push buttons, said slits provide for forming a pair of flexible tabs in the top portion of the first side and the opposite third side;

a top housing, said bottom housing slidably received inside said top housing, said top housing having an open bottom, a semi-open top, a first side, a second side, a third side and a fourth side, the first side and the opposite third side include an upper button hole and a lower button hole, whereby said button holes are used for receiving said push buttons on said tabs when said bottom housing is received inside said top housing, said upper button hole and said lower button hole used to adjust said top housing on said bottom housing for the small juice box or the large juice box; and a pair of inverted "L" shaped lifting handles attached to a top portion of the first and third sides of said top housing, said inverted "L" shaped handles offset from the vertical alignment of said button holes for ease in engaging and releasing said push buttons in said button holes and removing said top housing from said bottom housing, said inverted "L" shaped handles adapted for ease in gripping by a small child when using the juice box holder.

13. The holder as described in claim 12 wherein the semi-open top in said top housing has an inwardly extending frame therearound, said frame adapted for preventing the juice box from falling out of the holder should it be turned upside down.

14. The holder as described in claim 13 further including an offset rib having opposite ends attached to a portion of said frame next to the second and fourth sides of the semi-open top of said top housing, said offset rib adapted for preventing a juice box from falling out of the open top when the holder is turned upside down and providing additional strength to said top housing and preventing the second and fourth sides from being pressed inwardly and squeezing the top of the juice box causing a liquid spill.

15. The holder as described in claim 12 wherein the sides of said bottom housing and the sides of said top housing have a flat surface for adding advertising, logos, brand names, animals and children's pictures to enhance the appeal and use of the juice box holder.

* * * * *